US010766687B2

(12) United States Patent
Simmons et al.

(10) Patent No.: US 10,766,687 B2
(45) Date of Patent: Sep. 8, 2020

(54) PACKAGE OF DISPOSABLE WIPES

(71) Applicant: The Procter & Gamble Company, Cincinnati, OH (US)

(72) Inventors: John Norman Simmons, Mason, OH (US); Lawrence Andrew Schumacher, Trenton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 82 days.

(21) Appl. No.: 16/046,179

(22) Filed: Jul. 26, 2018

(65) Prior Publication Data

US 2019/0039813 A1 Feb. 7, 2019

Related U.S. Application Data

(60) Provisional application No. 62/540,095, filed on Aug. 2, 2017.

(51) Int. Cl.

| | |
|---|---|
| ***B65D 83/08*** | (2006.01) |
| ***A47K 10/42*** | (2006.01) |
| ***B65D 43/16*** | (2006.01) |
| ***B65D 75/58*** | (2006.01) |
| *A47K 10/32* | (2006.01) |

(52) U.S. Cl.

CPC ..... *B65D 83/0805* (2013.01); *A47K 10/421* (2013.01); *B65D 43/162* (2013.01); *B65D 75/5833* (2013.01); *A47K 2010/3266* (2013.01)

(58) Field of Classification Search

CPC ..... B65D 83/0805; B65D 43/162; B65D 75/5833; B65D 83/0841; B65D 83/0811; A47K 10/421; A47K 10/42; A47K 2010/3233; A47K 2010/3266

USPC ..... 206/494, 233

See application file for complete search history.

(56) References Cited

U.S. PATENT DOCUMENTS

| | | | | |
|---|---|---|---|---|
| 5,141,803 | A * | 8/1992 | Pregozen | A61K 8/0208 15/104.93 |
| 5,704,471 | A * | 1/1998 | Yamada | B65D 75/58 206/207 |
| 8,499,959 | B2 * | 8/2013 | Chasid | B65D 75/5838 206/233 |
| D720,219 | S * | 12/2014 | Yamada | D9/447 |
| 9,233,780 | B2 | 1/2016 | Cameron et al. | |
| 9,327,892 | B2 * | 5/2016 | Rubo | B65D 75/5838 |
| 9,730,562 | B2 * | 8/2017 | Yamada | A47K 10/423 |
| 2004/0251163 | A1 * | 12/2004 | Conde | B65D 83/0805 206/494 |
| 2005/0150785 | A1 * | 7/2005 | Julius | A47K 10/421 206/233 |
| 2013/0032608 | A1 * | 2/2013 | Hood | B65D 83/0805 221/45 |
| 2015/0216378 | A1 * | 8/2015 | Fulscher | A47K 10/421 221/45 |

(Continued)

*Primary Examiner* — Steven A. Reynolds

(74) *Attorney, Agent, or Firm* — Daniel S. Albrecht

(57) ABSTRACT

Disposable wipes packages containing improved opening and closing arrangements are disclosed. The packages are targeted for usage by adult caregivers and can provide reduced waste in comparison to some currently marketed wipe packages. Different forms of the packages disclosed herein include ratios of characteristics of the package closure fitments and those of the package body of wipes contained therein.

18 Claims, 4 Drawing Sheets

(56) References Cited

U.S. PATENT DOCUMENTS

| | | | | |
|---|---|---|---|---|
| 2015/0266633 | A1* | 9/2015 | Cameron | A47K 10/421<br>206/484.2 |
| 2016/0159534 | A1* | 6/2016 | Ujiie | B65D 75/5877<br>206/494 |

* cited by examiner

PACKAGE OF DISPOSABLE WIPES

CROSS REFERENCE TO RELATED APPLICATION

This application claims the benefit of U.S. Provisional Case 62/540,095, filed Aug. 2, 2017, the substance of which is incorporated herein by reference.

FIELD OF THE INVENTION

The present invention is generally directed to packages of disposable wipes moistened with a liquid composition (also known as "wet wipes").

BACKGROUND OF THE INVENTION

Wet wipes are currently sold for a variety of applications, including for use in personal cleansing in circumstances where soap, water, cloths, towels and a sink or washtub facility are unavailable or inconvenient. Wet wipes are also used for cleaning items other than human bodies, treating materials or surfaces, or delivering materials to a targeted area.

Wet wipes as packaged and sold typically comprise a stack of individually cut sheets, or a continuous folded stack or roll of material having perforations dividing the material into lengths that may be torn away at the perforations as individual sheets. The material of which the sheets are formed may be a nonwoven material formed of polymeric or natural fibers, or a combination thereof. The material is typically highly porous and capable of absorbing and holding a substantial fraction of its weight, or more, of a liquid composition. The stack or roll may be moistened or even saturated with the liquid composition. The liquid composition may be a solution or an emulsion, or a combination thereof, and may contain one or more cleansing agents, skin care agents, preservatives (antibacterial agents) and perfumes. As such, the wipes may constitute a convenient and pleasant product useful for a variety of personal cleansing applications, such as hand wipes, child wipes, baby wipes, etc.

In order prevent the water portion of the lotion from evaporating from the wipes stack or roll after manufacture and packaging, it is necessary to package the moistened or saturated stack in a container that substantially retains the moisture content over the expected time between manufacture and use of the product.

One way in which wet wipes are packaged is within a flow-wrap film package. A polymer film having a suitably low water vapor transmission rate is selected and used to form stock package material. Wet wipes stacks are formed and conveyed to a flow wrapping machine, which wraps the stock package material about each stack and forms seams in the material to join it to itself and seal it about the stack, thereby forming a moisture-retaining package of wet wipes that is sufficient to retain the moisture content from the time of manufacture to the time of purchase.

More is needed, however. Since a consumer will not ordinarily use the entire stack of wet wipes at one time, it may be desirable to provide some form of reclosable opening in the package, which allows the consumer to open the package easily and relatively non-destructively, withdraw wet wipes individually, and reclose the package. To retain the moisture in the remaining supply of wipes, it is desirable that the reclosure mechanism provide a sufficient barrier to moisture loss when properly closed.

Currently some flow-wrap wipes packages are sold with rigid plastic reclosable fitments. The fitment includes a frame or ring-shaped base member that is adhered substantially about its perimeter to a face of the package, and a reclosable lid portion hingedly connected to the base. The lid and base may have cooperating features designed to retard moisture transmission between their respective contacting edges or surfaces, when in a closed configuration.

The reclosable fitments on marketed wet wipe packages are relatively large; for example, PAMPERS and HUGGIES brand wet wipe packages comprise fitments that are approximately four inches wide. While the large size can facilitate ease of opening for adult caregivers, it can also facilitate opening by babies or toddlers. What is needed are smaller fitments that can be more difficult to open with hands of smaller size and less dexterity than average adults. Smaller fitments can also lead to less waste in the environment.

On the package face within the base of the fitment, the package film may have therein a perforated outline of a tearaway portion. The outline is a series of perforations through the film that outline a shape, usually a closed shape. Because the perforations through the film may allow moisture to escape and the fitment may not be sufficiently effective to retard moisture loss over the time between manufacturing and application of a fitment lid covering the perforations, or manufacturing and purchase, an adhesive-backed sticker/label of sufficient size to cover all of the perforations may be applied over the film within the base. When the consumer wishes to open the package, he or she may open the fitment lid and peel away the sticker. If the perforations, the shape, the sticker material and the adhesive are suitably selected and configured, the adhesive on the sticker will cause the underlying film within the perforated outline to remain adhered to the sticker, tear along the perforations, and pull away with the sticker, leaving an opening into the package in the shape of the perforated outline. The wipes may then be accessed and withdrawn through the opening. Following that, the consumer may reclose the lid, and the package may thereby retain moisture sufficiently during the time it takes for all of the wipes to be consumed.

The stickers create additional waste. They can also be inadvertently obtained by babies/toddlers if not disposed of properly or if a baby/toddler is able to manipulate the fitment to open the same before the sticker is removed for the first time.

Thus, there is a need for wet wipe packages that can lead to less waste and/or can have less access by minors.

SUMMARY OF EXEMPLARY FORMS

The present invention is directed to packages of substrates moistened with a liquid composition. In accordance with one form, there has now been provided a package of disposable wipes, wherein the package comprises a package body comprising a weakened region to facilitate creation of a dispensing opening upon first use of the package of wipes; a plurality of stacked wipes, at least some of which being moistened with a liquid composition; and a closure fitment situated over the weakened region. The closure fitment comprises a base that is attached to the package body proximate the weakened region and a lid that is moveable between an open position and a closed position, wherein the lid is in mechanical engagement with the base in the closed position. The weakened region is devoid of an applied adhesive-backed sticker. Each of the plurality of stacked wipes comprises a wipe width dimension measured along a lateral centerline of the wipe. The lid comprises a lid width dimension measured along a lateral centerline of the closure. And a ratio of the lid width dimension to the wipe width dimension is less than 0.55.

In accordance with another form, there has now been provided a package of disposable wipes, wherein the package comprises a package body comprising a weakened region to facilitate creation of a dispensing opening upon first use of the package of wipes; a plurality of stacked wipes, at least some of which being moistened with a liquid composition; and a closure fitment situated over the weakened region. The closure fitment comprises a base that is attached to the package body proximate the weakened region and a lid that is moveable between an open position and a closed position, wherein the lid is in mechanical engagement with the base in the closed position. The weakened region is devoid of an applied adhesive-backed sticker. The package body has a package width dimension measured along a lateral centerline of the package. The lid comprises a lid width dimension measured along a lateral centerline of the closure. And a ratio of the lid width dimension to the package width dimension is less than 0.38.

In accordance with yet another form, there has now been provided a package of disposable wipes, wherein the package comprises a package body comprising a polymeric film and a weakened region to facilitate creation of a dispensing opening upon first use of the package of wipes; a plurality of stacked wipes, at least some of which being moistened with a liquid composition; and a closure fitment situated over the weakened region. The closure fitment comprises a base that is attached to the package body proximate the weakened region and a lid that is moveable between an open position and a closed position wherein the lid is in mechanical engagement with the base in the closed position. The weakened region is devoid of an applied adhesive-backed sticker. The polymeric film defines a package body mass. The base and lid together define a closure mass. And a ratio of the closure mass to the package body mass is less than or equal to 1.50.

BRIEF DESCRIPTION OF THE DRAWINGS

The following detailed description of specific forms of the present invention can be best understood when read in conjunction with the drawings enclosed herewith.

DETAILED DESCRIPTION

The following text sets forth a broad description of numerous different forms of the present invention. The description is to be construed as exemplary only and does not describe every possible form since describing every possible form would be impractical, if not impossible. And it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative forms could be implemented, using either current technology or technology developed after the filing date of this patent, which would still fall within the scope of the claims. All publications and patents cited herein are incorporated herein by reference.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
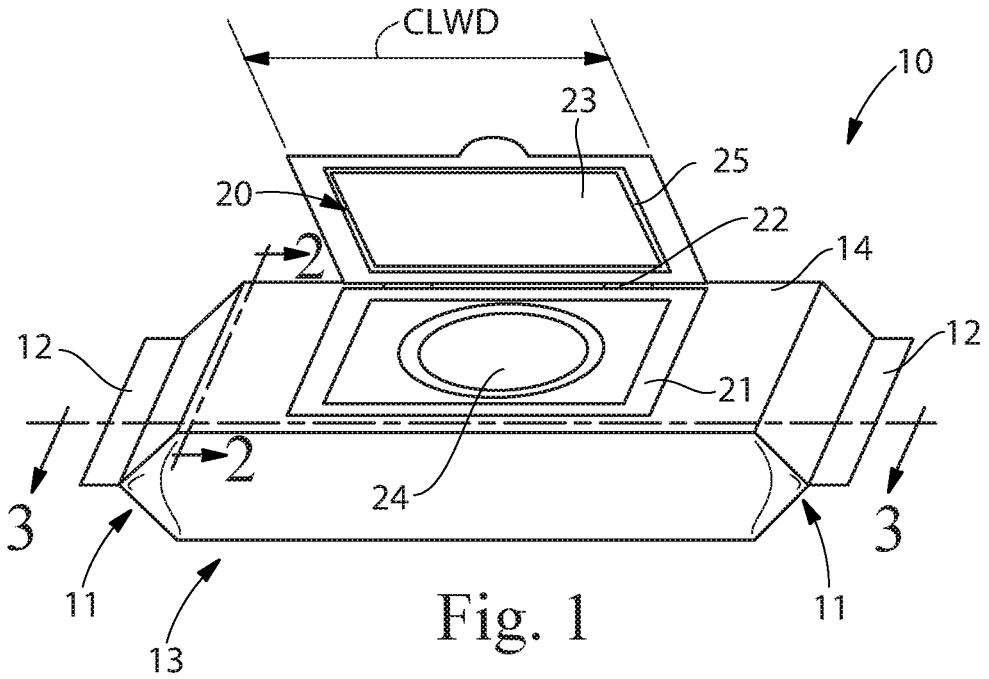
FIG. 1 is a perspective view of a package of wet wipes.
Figure 2:
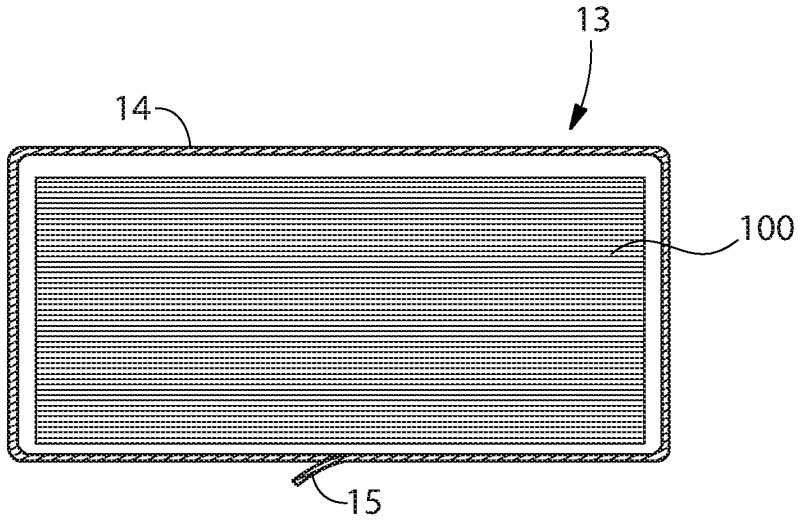
FIG. 2 is a cross-section of the package of FIG. 1, taken through line II-II shown in FIG. 1.
Figure 3:
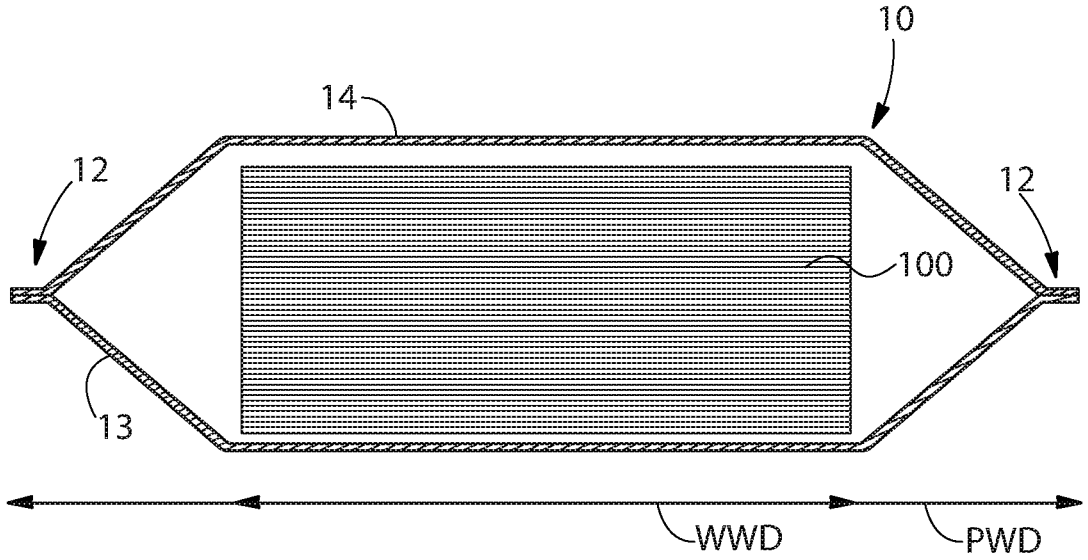
FIG. 3 is a cross-section of the package of FIG. 1, taken through line III-III shown in FIG. 1.

The present invention is generally directed to packages disposable wipes. FIGS. 1-3 depict a wet wipes package 10. Wet wipes package 10 may contain a stacked supply of wipes 100 formed of a suitable substrate of nonwoven web material. The packages of the present invention are preferably configured for dispensing stacks of folded wipes and not a convolutely wound series of wipes. While the wipes may be connected and separated, for example via perforations, the stacked wipes are preferably discrete and not connected to one another. Instead, they are simply stacked on top of one another or partially nested with one another.

The wipes may be moistened with a liquid composition by the manufacturer or packager, or alternatively moistened by the end user after purchasing the package of substrates. A typical liquid composition comprises an aqueous lotion composition. Various non-limiting examples of aqueous lotion compositions are described in U.S. patent application Ser. Nos. 11/048,446; 12/771,391; and Ser. No. 12/974,731. The lotion compositions may contain more than 80%, 85%, 90%, 95%, or 98.5% by weight water (or other solvent).

Package 10 comprise a package body 13 formed of a flexible packaging material that encases a stack of wet wipes. Useful packaging materials can comprise polymeric films (one or more layers), paperstock, waxed paper, foils, fibrous webs (nonwovens, wovens), and combinations thereof. One particular packaging material example is a multi-layered polymeric film formed of one or more polyolefins, such as polypropylene or a blend of resins containing a predominate weight percentage of polypropylene for a first layer; and polyethylene or a blend of resins containing a predominant weight percentage of polyethylene for a second layer. In a non-limiting example, a layer formed predominately of polypropylene having a first relatively higher melting temperature, and a layer formed of predominately of polyethylene having a second relatively lower melting temperature, may be used to form the outer and inner layers, respectively. A predominately polyethylene layer having a thickness of not less than 35 μm, more preferably not less than 38 μm, more preferably not less than 43 μm, and still more preferably not less than 48 μm, may form the inner layer. The outer layer may be a predominately polypropylene layer having a thickness of not less than 10 μm, more preferably not less than 15 μm, and still more preferably not less than 20 μm.

The selected packaging material may be unwound from a stock roll and passed in a longitudinal/machine direction into a flow-wrap machine, along with individual wipes stacks. The flow-wrap machine may be configured so as to wrap the packaging material stock longitudinally about each incoming stack, join the packaging material along its longitudinal edges to form a sealed fin seam 15 and a sleeve-like structure about the stack, tuck the packaging material at the ends to form tucks 11, and then crimp, seal and cut the packaging material between each stack, forming individual packages 10 of wipes having end seams 12. Other known methods of manufacturing flexible packages may be employed to make the packages described and claimed herein.

Figure 4:
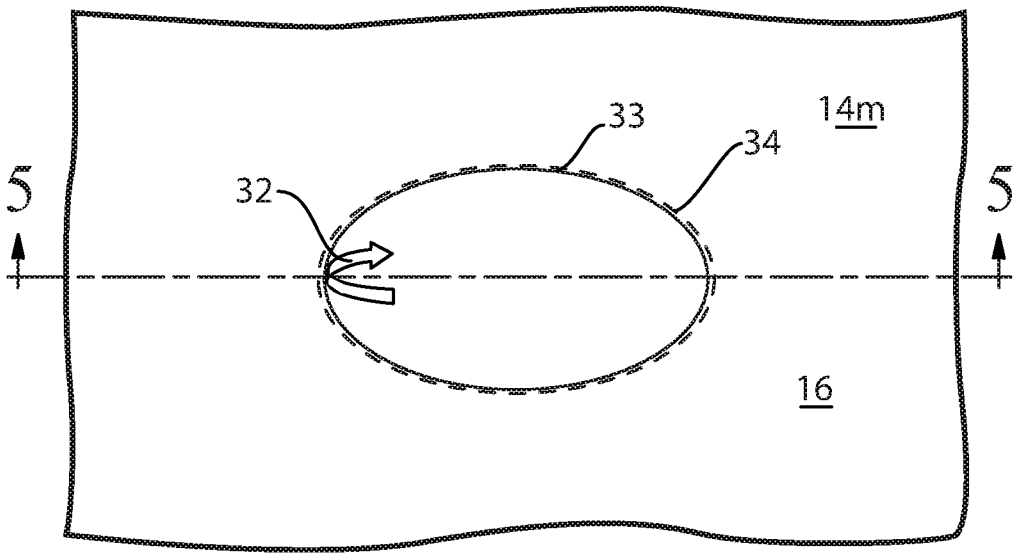
FIG. 4 is a plan view of a portion of the wipes package face with a scored groove defining a weakened region to be manipulated by a user to create an access opening post purchase.
Figure 5:
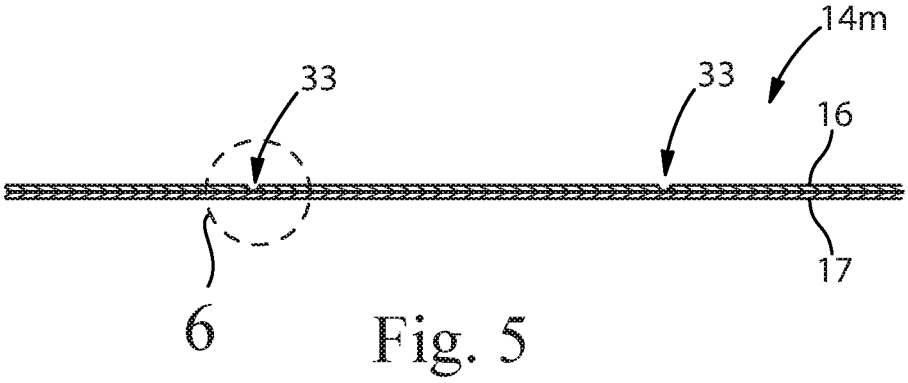
FIG. 5 is a cross section of the portion of the wipes package face of FIG. 4, taken through line V-V shown in FIG. 4.
Figure 6:
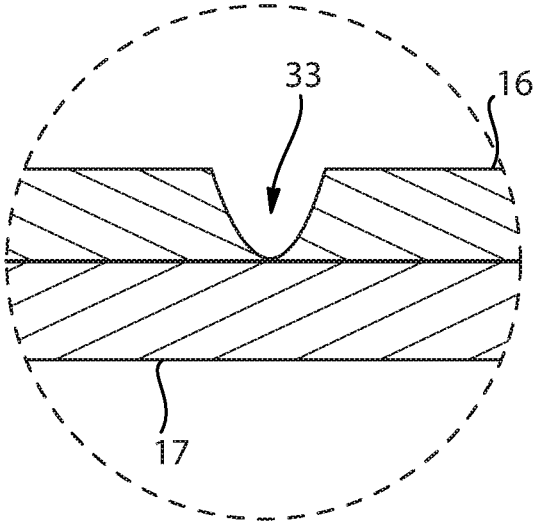
FIG. 6 is an enlarged view of a portion of the cross section shown circled in FIG. 5.

Referring now to FIG. 4, package 10 comprises a weakened region 24 that can be manipulated for providing access to the contained wipes. The weakened region 24 can be defined by a line of weakness 33 created by perforation, scoring, or embossing, for example. In one form, the packages comprise a weakened region having a boundary defined by a discontinuous line of laser score segments. Laser scoring may be performed using a laser light source, which may be selected by light frequency and power to penetrate the packaging material to a desired depth. Under certain circumstances, a laser may be selected and/or adjusted to score through one type of packaging material without substantially scoring through another. Accordingly and with reference to FIGS. 5 and 6, a multi-layered film 14*m* comprising layers 16 and 17 may be selected to form package 10, and a laser light source may be selected and/or adjusted so as to be suitable to score (score grooves are labeled 33) substantially through only one of the layers 16. Suitable laser scoring equipment is available, for example, from LasX Industries, Inc., St. Paul, Minn.

Weakened region 24 may optionally comprise indicium to indicate the location of the weakened region and to instruct a consumer how to manipulate the same to create an opening access to the contained wipes. By way of example and with reference again to FIG. 4, weakened region 24 comprises laser score segments 33, a first indicium 34 to highlight the location and scope of weakened region 24, and a second indicium 32 to communicate removal of the weakened region upon manipulation of the same to create the access opening.

The shape characteristics of the weakened region 24 formed by the scored groove 33 may be deemed important. It may be preferable that the shape be selected from the group consisting of circle, oval, ovaloid, ellipse, egg-shape, rounded rectangle (rectangle with rounded corners), or any shape that lacks sharp corners. Alternatively, it may be preferable that the scored groove 33 include few or no sharp turns or corners, which can have the effect of localizing stresses that can promote tear propagation that strays beyond or outside of the groove. Thus, it may be preferred that the scored groove 33 does not include any curve having a radius less than 5 mm along any portion thereof. A circular, oval or elliptical shape may be more preferred, and an oval or elliptical shape most preferred. Additionally, it may be preferred that the selected shape have an aspect ratio of greatest dimension to smallest dimension not exceeding 4.0, more preferably not exceeding 3.0, more preferably not exceeding 2.5, and still more preferably not exceeding 2.0. This may help ensure that any curves in the scored outline are not so sharp as to concentrate tearing stresses to an extent therealong that promotes propagation of tears that stray beyond or outside the scored groove 33. One or more of these characteristics may be important to reduce the possibility that a tear, initiated by the consumer attempting to create an access opening, will propagate outside or beyond the scored groove, resulting in a misshapen, unsightly opening, compromising the moisture-retaining functionality of the package, or simply frustrating the consumer.

Figure 7:
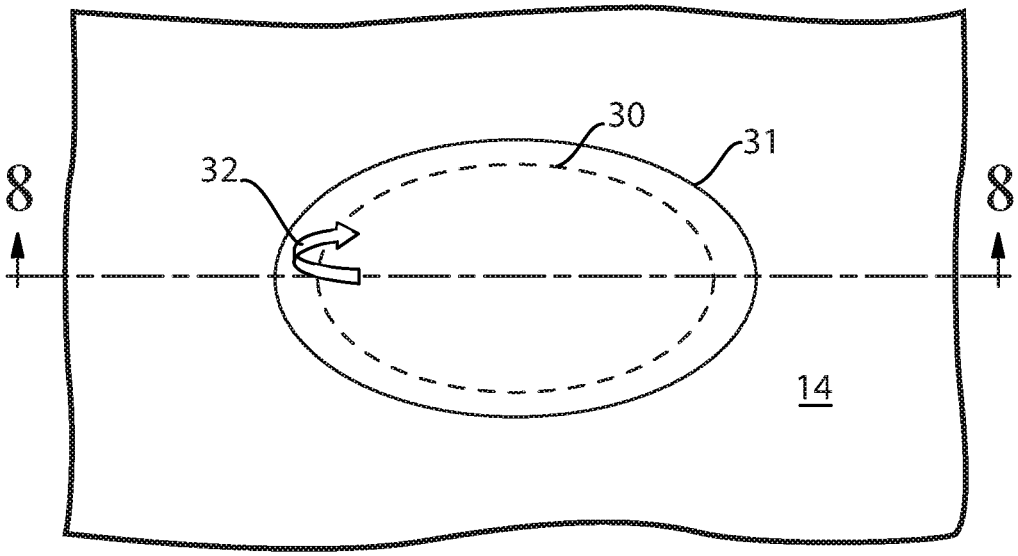
Fig. 7 (PRIOR ART)
FIG. 7 is a plan view of a portion of a wipes package face with an outline of perforations covered by a sticker overlabel.
Figure 8:
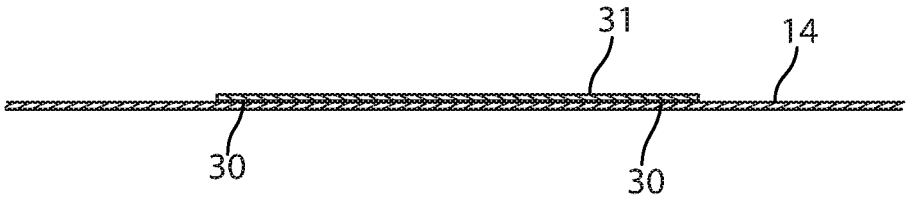
Fig. 8 (PRIOR ART)
FIG. 8 is a cross section of the portion of the wipes package face of FIG. 7, taken through line VIII-VIII shown in FIG. 7.

A benefit of defining the weakened region with a line of weakness that does not extend all the way through one or more layers of the packaging material is to eliminate the need for an overlabel seal to preserve the desired moistness level associated with the wipes before they are purchased and used for the first time. For example and with referenced to FIGS. 7 and 8, some prior art wipe packages employed an applied adhesive-based sticker 31 to cover a weakened region created by perforated line comprising perforations 30 extending entirely through the thickness of the packaging material film 14. These applied adhesive-based stickers create additional waste. They can also be inadvertently obtained by babies/toddlers if not disposed of properly or if a baby/toddler is able to manipulate a closure fitment before the sticker is removed for the first time. Some forms of the present invention accordingly are devoid of an applied adhesive-backed sticker.

Referring again to FIG. 1, package 10 also comprises a relatively rigid, recloseable closure fitment 20. Closure fitment 20 comprises a ring or frame-shaped base 21, and a lid 23 connected to the base 21 by a hinge 22. Base 21 is typically adhered substantially along and about its perimeter to the upper material surface of the package 10 so as to provide a substantial moisture seal between the closure fitment and the package body. Lid 23 may have an open position and a closed position.

One or both of lid 23 and base 21 may optionally be provided with lip, rim, groove, gasket etc. cooperating sealing features 25 such that, when the lid is in the closed position, the cooperating sealing features 25 of lid 23 and/or base 21 are in close proximity or effective contact with the other of lid 23 and/or base 21 about the perimeter of the lid, so as to retard the passage of moisture between the lid 23 and the base 21. One example may be a gasket (not specifically shown) formed of a material that is relatively softer than the material forming the closure fitment may be provided about the weakened region 24 (and resulting opening upon manipulation of the same) and disposed on either the lid 23 or base 21, to improve the moisture passage retarding function. The closure fitment including the base 21, hinge 22 and lid 23 may be formed of a polymer such as a polyolefin, for example, polyethylene, and manufactured through an extrusion molding technique.

As noted in the background section, closure fitments on currently marketed wet wipe packages are relatively large; for example, PAMPERS and HUGGIES brand wet wipe packages comprise fitments that are approximately four inches wide. While the large size can facilitate ease of opening for adult caregivers, it can also facilitate opening by babies or toddlers. What is needed are smaller fitments that can be more difficult to open with hands of smaller size and less dexterity than average adults. Smaller fitments can also lead to less waste in the environment.

Forms of the present invention are directed to closure fitment parameters as they relate to parameters of the packaging body and the contained wipes. For example, in one form, a ratio of a closure lid width dimension to a wipe width dimension is less than 0.55, and preferably less than or equal to 0.50. In another form, a ratio of a closure lid width dimension to a package width dimension is less than 0.38, and preferably less than or equal to 0.35. In yet another form, a ratio of closure mass (base and lid) to package body mass is less than or equal to 1.50, 1.25, or 1.00. Measurement techniques for the before-mentioned parameters are described below.

Measurement of Package, Closure Fitment, and Wipe Parameters

The following method describes the measurement of selected parameters of the package, the package closure fitment, and wipes contained by the package.

All testing is performed in a room controlled at 23° C.±2° C. and 50%±2% relative humidity. Condition all samples for at least two hours prior to preparation and measurements. Use the following implements to perform the measurements: 1) ruler traceable by NIST or similar organization; and 2) analytical balance capable to measure to 0.01 g.

Five samples are tested. The closure lid and base are removed and the adhesive (if present) is removed completely from the lid and package body. The package is opened by cutting along a major axis. The wipes are removed and the empty package body material is washed to remove any traces of potential additives or liquid composition and dried.

The mass of the package body material and closure members are measured and recorded in grams to the second decimal. The width dimension (or major axis dimension before cutting the package opened) is measured along a lateral centerline of the package (including existing end seals—see, for example, FIG. 1), the closure, and the wipe in millimeters to the first decimal. For example, see measurement direction reference line CLWD in FIG. 1 for the closure fitment lid width dimension, and measurement direction reference lines PWD and WWD in FIG. 3 for the package width dimension and wipe width dimension, respectively.

The average of five replicates of the measured parameters are recorded. Data from a marketed PAMPERS brand product, a marketed HUGGIES brand product, and an exemplary form of the present invention (Example A) are provided in Table 1 below.

TABLE 1

| Wipe Package Attributes | | | |
|---|---|---|---|
| | PAMPERS Wipe Package | HUGGIES Wipe Package | Example A |
| Closure (lid and base) Mass (g) | 11.31 | 11.17 | 6.08 |
| Package Body Material Mass (g) | 7.05 | 5.53 | 6.37 |
| Closure Lid Width Dimension (mm) | 105.0 | 106.8 | 88.0 |
| Package Width Dimension (mm) | 265.4 | 270.2 | 254.0 |
| Wipe Width Dimension (mm) | 176.0 | 166.6 | 175.0 |

TABLE 1-continued

| Wipe Package Attributes | | | |
|---|---|---|---|
| | PAMPERS Wipe Package | HUGGIES Wipe Package | Example A |
| Ratio of Closure Mass to Package Body Mass | 1.60 | 2.02 | 0.95 |
| Ratio of Closure Lid Width to Package Width | 0.40 | 0.40 | 0.35 |
| Ratio of Closure Lid Width to Wipe Width | 0.60 | 0.64 | 0.50 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular forms of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package of disposable wipes, the package comprising:

a. a package body comprising a weakened region to facilitate creation of a dispensing opening upon first use of the package of wipes;

b. a plurality of stacked wipes, at least some of which being moistened with a liquid composition; and c. a closure fitment situated over the weakened region, the closure fitment comprises a base that is attached to the package body proximate the weakened region and a lid that is moveable between an open position and a closed position, wherein the lid is in mechanical engagement with the base in the closed position;

d. wherein the weakened region is devoid of an applied adhesive-backed sticker;

e. wherein each of the plurality of stacked wipes comprises a wipe width dimension;

f. wherein the lid comprises a lid width dimension; and g. wherein a ratio of the lid width dimension to the wipe width dimension is less than or equal to 0.55.

2. The package of claim 1, wherein the ratio of the lid width dimension to the wipe width dimension is less than or equal to 0.50.

3. The package of claim 1, wherein the weakened region is defined by a score line.

4. The package of claim 1, wherein the weakened region is defined by a plurality of discontinuous score units that do not extend all the way through the material defining the packaging body.

5. The package of claim 1, wherein the weakened region is defined by a laser score.

6. The package of claim 1, wherein at least one of the closure fitment base and the closure fitment lid is injection molded.

7. The package of claim 1, wherein the closure lid is not in direct contact with the package body in the closed position.

8. The package of claim 1, wherein the closure lid does not comprise adhesive.

9. The package of claim 1, wherein the closure lid and the closure base are pivotally connected.

10. The package of claim 1, wherein a hinge is disposed between the closure lid and the closure base.

11. The package of claim 1, wherein each of the plurality of wipes comprises cotton fibers.

12. The package of claim 1, wherein the liquid composition comprises 98.5% or more of water.

13. A package of disposable wipes, the package comprising:

a. a package body comprising a weakened region to facilitate creation of a dispensing opening upon first use of the package of wipes;

b. a plurality of stacked wipes, at least some of which being moistened with a liquid composition; and c. a closure fitment situated over the weakened region, the closure fitment comprises a base that is attached to the package body proximate the weakened region and a lid that is moveable between an open position and a closed position, wherein the lid is in mechanical engagement with the base in the closed position;

d. wherein the weakened region is devoid of an applied adhesive-backed sticker;

e. wherein the package body comprises a package width dimension;

f. wherein the lid comprises a lid width dimension; and g. wherein a ratio of the lid width dimension to the package width dimension is less than 0.38.

14. The package of claim 13, wherein the ratio of the lid width dimension to the package width dimension is less than or equal to 0.35.

15. The package of claim 13, wherein the weakened region is defined by a laser score.

16. A package of disposable wipes, the package comprising:

a. a package body comprising a polymeric film and a weakened region to facilitate creation of a dispensing opening upon first use of the package of wipes;

b. a plurality of stacked wipes, at least some of which being moistened with a liquid composition; and c. a closure fitment situated over the weakened region, the closure fitment comprises a base that is attached to the package body proximate the weakened region and a lid that is moveable between an open position and a closed position, wherein the lid is in mechanical engagement with the base in the closed position;

d. wherein the weakened region is devoid of an applied adhesive-backed sticker;

e. wherein the polymeric film defines a package body mass;

f. wherein the base and lid together define a closure mass; and g. wherein a ratio of the closure mass to the package body mass is less than or equal to 1.0.

17. The package of claim 16, wherein the weakened region is defined by a plurality of discontinuous score units that do not extend all the way through the material defining the packaging body.

18. The package of claim 16, wherein the weakened region is defined by a laser score.

* * * * *